United States Patent [19]

Brun et al.

[11] Patent Number: 4,512,695

[45] Date of Patent: Apr. 23, 1985

[54] APPARATUS FOR SEPARATING ELECTROLYSIS BATH RESIDUES ON PRECALCINED ANODES

[75] Inventors: Marcel Brun, Asnieres; Andre Perret, Chatou; Claude Cailleux, Combs-la-Ville, all of France

[73] Assignee: Aluminium Pechiney, Lyons, France

[21] Appl. No.: 394,467

[22] Filed: Jul. 1, 1982

[30] Foreign Application Priority Data

Jul. 23, 1981 [FR] France ..... 81 14792

[51] Int. Cl.[3] ..... B23C 3/14

[52] U.S. Cl. ..... 409/134; 409/137; 409/197; 409/201; 409/203; 15/93 R

[58] Field of Search ..... 409/137, 199, 134, 189, 409/197, 201, 203, 190, 191, 192; 29/81 J; 15/93 R

[56] References Cited

U.S. PATENT DOCUMENTS 321,698 7/1885 Eberhardt et al. ..... 409/137

3,533,327 10/1970 Hagerty ..... 409/137

4,145,954 3/1979 Schilder ..... 409/199 X

*Primary Examiner*—Z. R. Bilinsky

*Attorney, Agent, or Firm*—Dennison, Meserole, Pollack & Scheiner

[57] ABSTRACT

The invention relates to an apparatus for carrying out a process for separating electrolysis bath residues on used anode units removed from electrolysis cells for the production of aluminum by the Hall-Heroult process, said units comprising a cabon residue 5 or "butt", in which are sealed discs 3 interconnected by flanges 2 welded to a suspension rod 13, the axes of the discs 3 being parallel to the axis of the suspension rod 13, said process comprising passing at least one rotary milling cutter 9, of which the axis of rotation 10 in the working position is substantially parallel to the axis of the rod 13, through the space situated between the discs and around the discs 3 and defined by the upper face of the carbon butt 5 on the one hand and the flanges 2 on the other hand.

6 Claims, 5 Drawing Figures

APPARATUS FOR SEPARATING ELECTROLYSIS BATH RESIDUES ON PRECALCINED ANODES

Figure 1:
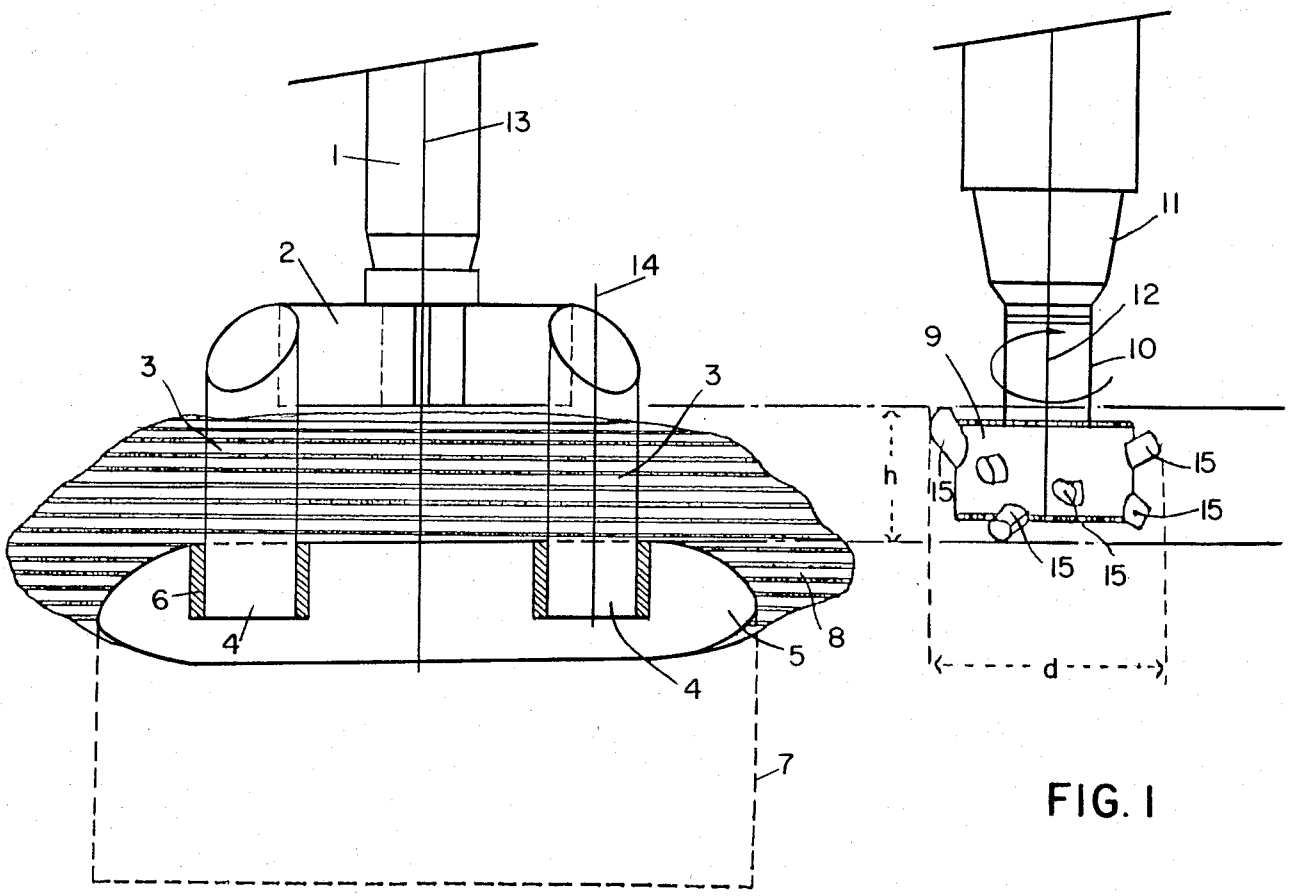

This invention relates to a process and an apparatus for separating electrolysis bath residues on used precalcined anodes removed from electrolysis cells for the production of aluminum by the Hall-Heroult process.

In electrolysis cells of the type in question, each anode unit comprises a molded and precalcined carbon block comprising a certain number of closed cavities in which suspension and electrical connection means are sealed by casting a special molten cast iron casting or, in some cases, by means of a carbon-containing paste. These means are generally steel studs, usually two to six in number, connected by flanges which are themselves welded to a suspension rod which is designed to lock onto the anode bar. A system of this type is described for example in French Pat. No. 1,519,475 (U.S. Pat. No. 3,351,546) or in French Pat. No. 2,350,407 (U.S. Pat. No. 4,119,505), both in the name of Aluminium Pechiney.

After an anode has been used, the entire anode unit is replaced. It comprises four recoverable and recyclable elements, namely:

- the rod-flange assembly which will be resealed in a new precalcined anode;
- the carbon residue or "butt" which, after suitable treatment, will be used as one of the constituents of the anode paste;
- the electrolysis bath accumulated on the anode in the form of crusts which, after suitable treatment, will be reintroduced into the cells;
- the sealing cast iron casting which will be reused for sealing new anodes.

The present invention is concerned with the separation of electrolysis bath crusts from the remainder of the anode system.

This operation is normally carried out using more or less mechanized means in the form of scrapers, picks, optionally vibrating power chisels, rakes, completed in some cases by the action of vibrating platforms which remove bath material detached from the anode unit. Equipment of this type requires the continuous presence and intervention of operators under often hard conditions of heat, noise and dust which is difficult to contain.

The above-mentioned French Pat. No. 2,350,407 describes an arrangement for breaking up crusts by pressure and impact which may be fitted to a service vehicle, for example of the semi-gantry type.

The present invention is based on a totally different principle.

The process according to the invention for separating electrolysis bath residues on used anode units removed from cells for the production of aluminum by the Hall-Heroult process, said units comprising a carbon residue or "butt" in which are sealed studs interconnected by flanges welded to a suspension rod, the axes of the studs being parallel to the axis of the suspension rod, comprises passing at least one rotary milling cutter, of which the axis of rotation in the working position is substantially parallel to the axis of the rod, through the space situated between the studs and around the studs and defined by the upper face of the carbon butt on the one hand and by the flanges on the other hand.

The anode units may be fixed and the milling cutter displaceable or, conversely, the milling cutter may be fixed and the anode unit displaceable in such a way that milling cutter passes through the space between the studs and around the studs.

The present invention also relates to an apparatus for carrying out the process comprising means for gripping and positioning the anode units and rotary milling cutters of which the axis is substantially parallel to the axis of the rod in their working position.

The apparatus according to the invention may additionally comprise means for placing a hood over and extracting dust and for removing the electrolysis bath residues.

The apparatus enables the anode unit to be vertically adjusted and may be designed either for the displacement of the milling cutters relative to the fixed anode unit or for the displacement of the anode unit in a plane perpendicular to the axis of the rod in relation to the fixed milling cutters.

The apparatus according to the invention lends itself particularly well to complete programming and automation.

FIGS. 1 to 4 diagrammatically illustrate the various elements of the invention.

On its left-hand side, FIG. 1 shows in section an anode unit comprising a rod 1, the flanges 2 connecting the studs 3 sealed in cavities 4 of the anode 5 by means of case iron castings 6. The dotted line 7 represents the approximate contours of a new anode.

When the anode butt 5 is removed from the electrolysis cell, it is covered with a thick layer of crusts 8 of electrolysis bath based on cryolite which has to be recovered for recycling after a suitable treatment.

On the right-hand side of the Figure, the rotary tool 9, which will be referred to hereinafter as a "cutter" and which is fixed to the tool holder 10, is rotated by known means 11, such as an electric, hydraulic or pneumatic motor, the axis of rotation 12 in the working position being substantially parallel to the axis 13 of the rod and hence to the axis 14 of the studs 3.

The cutter 9 comprises a plurality of preferably removable and interchangeable teeth 15. These teeth may be made of steel or of any hard material which is resistant to wear by abrasion and to impact, such as certain metal carbides, or of steel coated with carbides, carbonitrides or nitrides or hardened by diamonds, this list being given purely by way of nonlimiting example. A machine with a tool-holder chain of the coal cutting machine type would be an equivalent means for breaking up and removing the electrolysis bath.

The external diameter d of the cutter as measured at the end of the teeth is substantially equal to or very slightly smaller (a few millimeters) than the side-to-side distance between the studs 3. The maximum overall height h is determined in dependence upon the available height between the flanges 2 and the upper part of the butt 5. The tool holder 10 is also vertically adjustable.

It would not be contrary to the concept underlying the invention for the cutter 9 to have a height h less than the available height between the flanges 2 and the upper part of the butt. In that case, separation of the bath residues would be carried out for example in two successive passes, the cutter being vertically displaced after the first pass.

The cutting of the electrolyte crusts 8 by the cutter 15 is carried out by a relative movement between the anode unit and the cutter. The anode unit may be fixed, in which case it is the cutter or a plurality of cutters which moves, or alternatively the cutter(s) is/are fixed, in which case it is the anode unit which moves and stops in front of the cutters, the axis of the rod 13 remaining parallel to itself and to the axis of rotation 12 of the cutters.

A double combined movement of the anode units and cutters is also possible.

Figure 2:
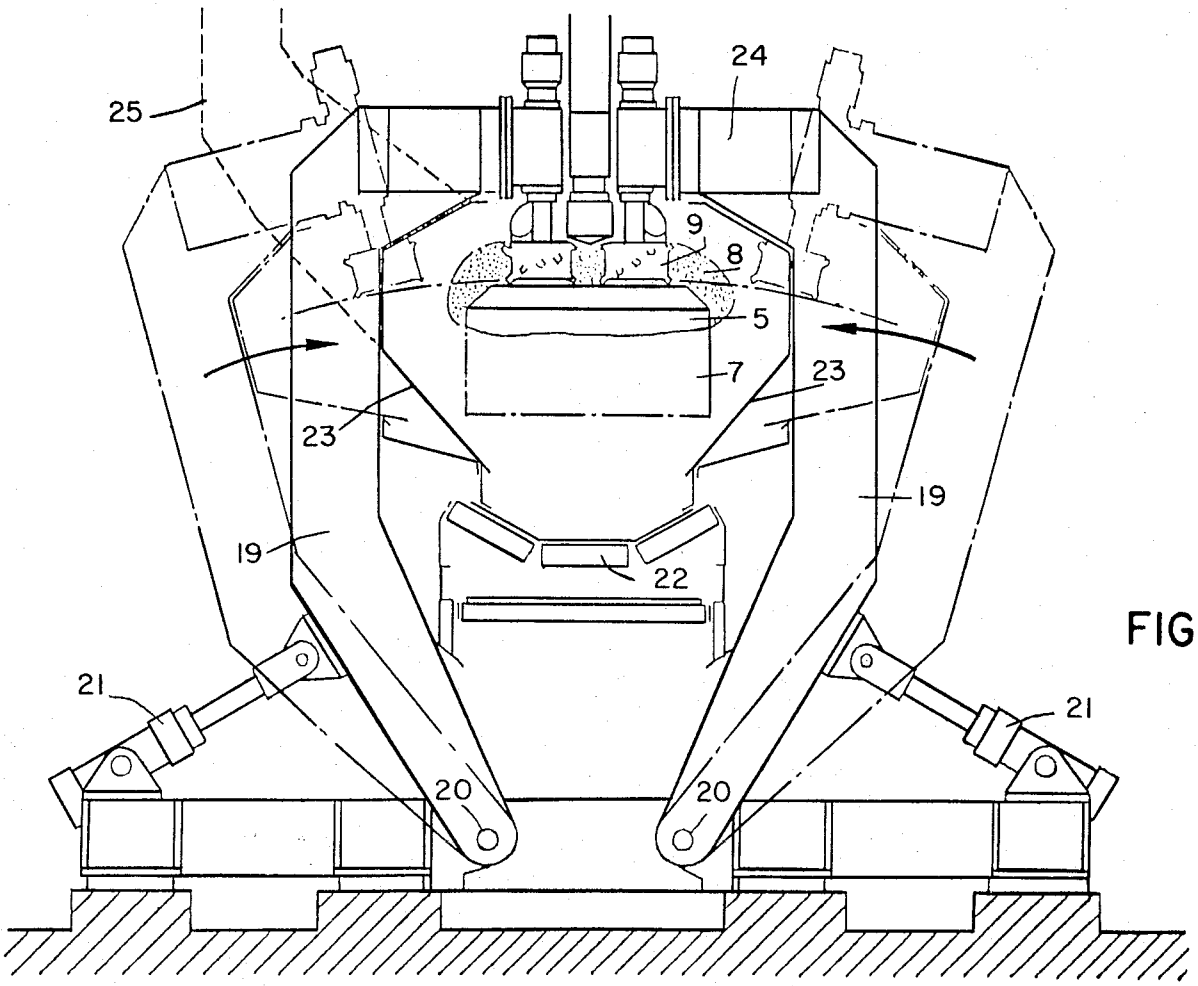
Figure 3:
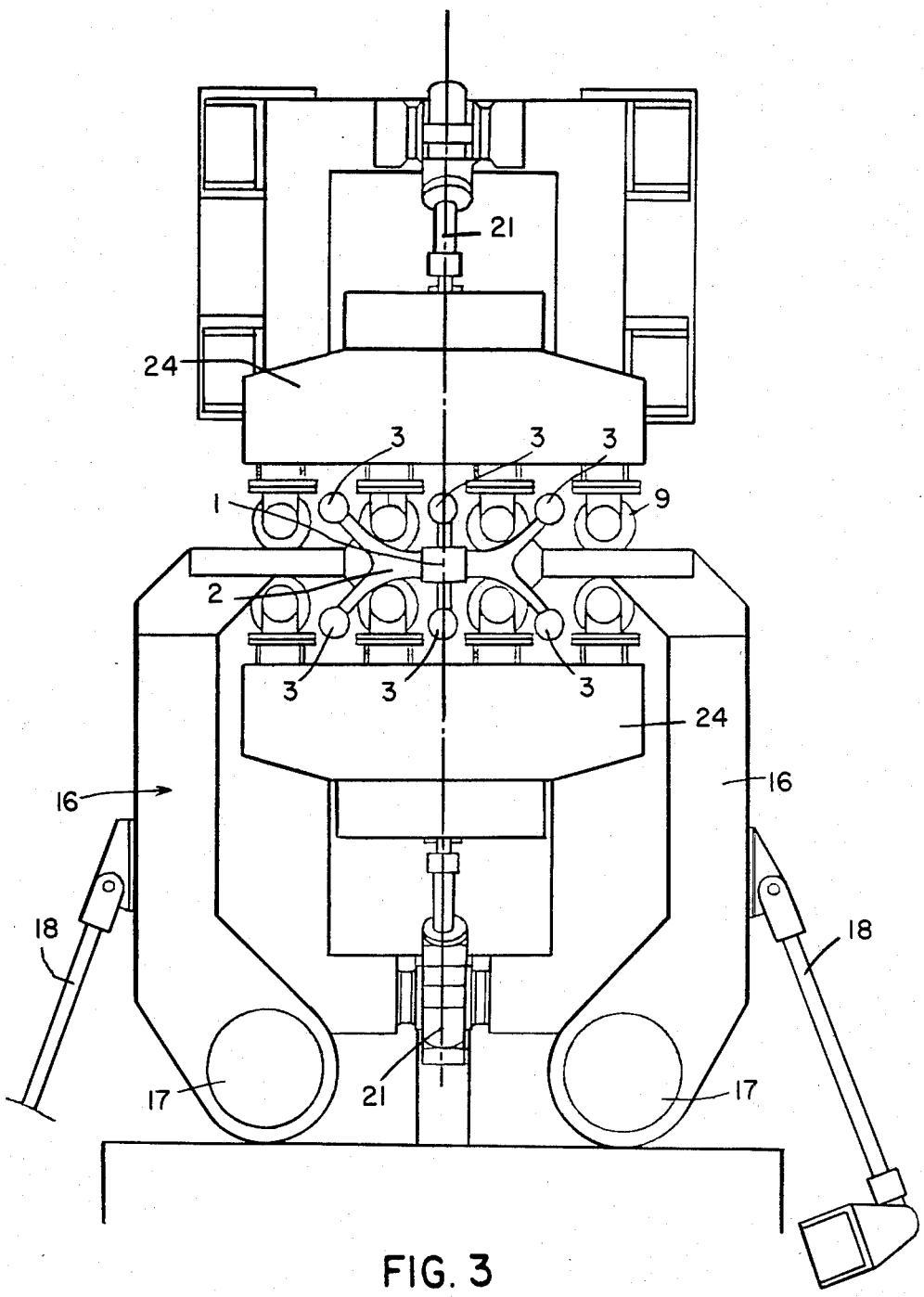

FIG. 2 is a vertical section through and FIG. 3 a plan view of a practical embodiment in which the anode unit is fixed and the cutters displaceable.

In this case, the anode unit comprises six sealed studs 3. It is fixed by gripper arms 16 pivotally connected to shafts 17 controlled by jacks 18 after having been moved into position by an overhead conveyor (not shown).

The cutters 9, in this case eight in number arranged in two rows of four, are mounted with the means by which they are rotated on a positioning unit which, in the present case, is formed by arms 19 mounted to pivot about a shaft 20 under the control of jacks 21.

The broken line in FIG. 2 corresponds to the position of the arms 19 during the positioning or removal of the anode unit.

To carry out the operation, the arms 19 are progressively oscillated while the cutters are rotated. During this movement, the axis of rotation of the cutters is not strictly parallel to the rod 13 at the moment when they reach their working position and cutting begins. However, the angular difference is relatively minor, on the order of 10° or less, which enables the axis of rotation to be described as "substantially parallel to the rod 13" when the cutters are in their working position.

The pulverized electrolyte debris and the blocks which break up under the impact of the teeth 15 fall either into a receptacle or onto a conveyor 22. Deflectors 23 which form a hood prevent dust and electrolyte debris from spreading throughout the factory. The hood is preferably connected to a conventional extraction system (not shown) of which the outlet is represented by the pipe 25. The deflectors 23 may be fixed or may consist of at least two separate parts integral with gripper arms 16.

In FIG. 3, which is a plan view, the position of the cutters and the supporting arms corresponds to the final position which they reach at the end of the cutting operation.

Figure 4A:
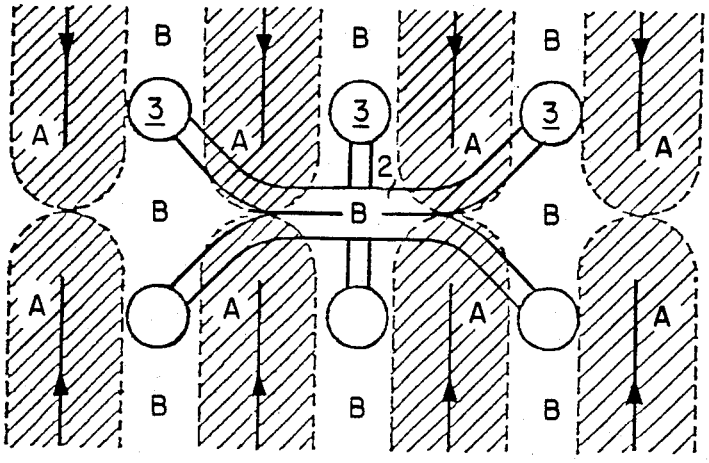
Figure 4B:
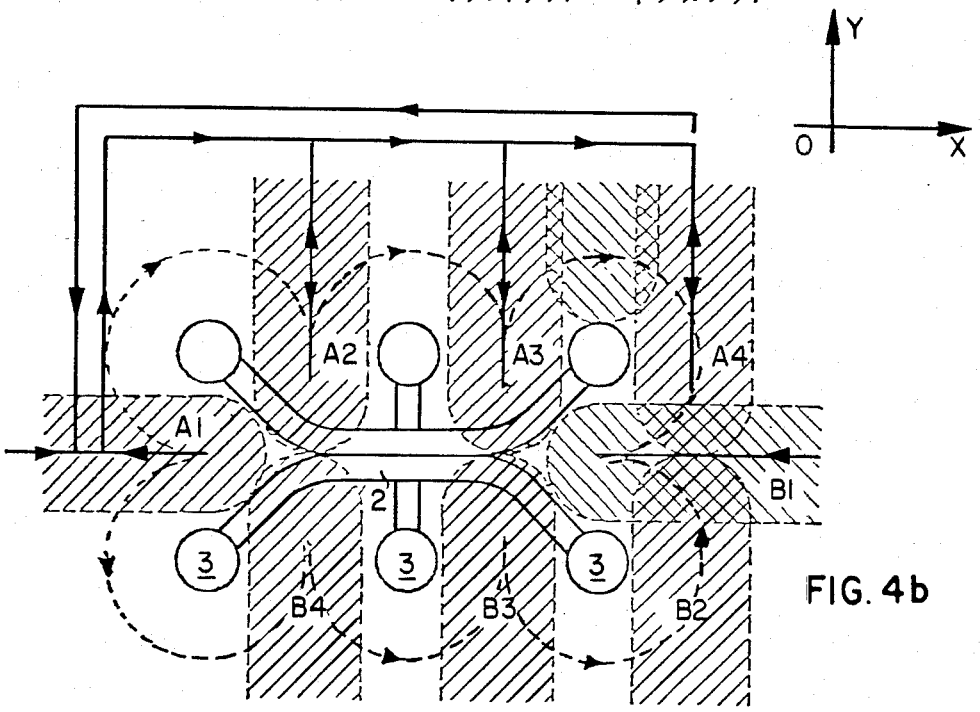

FIG. 4, which is a plan view, shows in the hatched areas the various possible paths of the cutting tool(s). In other words, the invention may be put into effect in different ways.

In variant **4*a*, which corresponds to FIG. 3, the cutters pass through the spaces marked A. Theoretically, the spaces marked B escape the effect of the cutters although experience has shown that impact of the teeth 15** causes the electrolyte crusts to break up and that the spaces marked B are practically cleaned on completion of the operation.

In variant **4*b***, a single cutter which may travel in the plane defined by the axes OX and OY under the effect of any known conventional means may pass successively through the spaces $A_1$, $A_2$, $A_3$, $A_4$, $B_1$, $B_2$, $B_3$, $B_4$. It would also be possible for two cutters traveling in synchronism to pass respectively through the spaces $A_1A_2A_3A_4$ and $B_1B_2B_3B_4$. Displacement may be obtained by successive movements along the axes OX and OY, as indicated by the solid-line arrows, or along curved paths by a combination of movements along the axes OX and OY, as indicated by the broken line arrows, which enables the cutters to cover the entire space between the discs and around the discs without leaving any dead zones.

This mechanism by which the cutters are displaced along the plane OX-OY may readily be positioned in the upper part 24 of the pivotal arms 19.

Any combination of displacement of one or more cutters relative to studs 3 and in the gaps between them in the space defined at its lower end by the upper surface of carbon butt 5 and at its upper end by flanges 2 falls within the scope of the present invention.

The movements of the arm(s) are preferably controlled by a programming unit comprising a mechanical, hydraulic, pneumatic, electrical, electronic or electromechanical device or a microprocessor, enabling the cutters to pass through the spaced to be cleaned while at the same time avoiding obstacles forming an integral part of the anode unit, such as steel discs or crossbars.

Since the anode units are assembled with relatively narrow tolerances, the programming of these movements, even in a factory where anodes with 6 discs and anodes with 2, 3 or 4 sealing discs are present, does not involve any particular problem.

Gripper arms 16 may also comprise means for vertically adjusting the anode units.

The process and apparatus according to the present invention enable electrolysis bath residues to be rapidly and completely eliminated under excellent conditions of hygiene and safety and the various elements of the anode system to be completely recovered for recycling.

We claim:

1. An apparatus for removing electrolysis bath residues from at least one used anode unit removed from an electrolysis cell for the production of aluminum by the Hall-Heroult process, wherein said at least one anode unit comprises a carbon residue, a plurality of studs sealed within said carbon residue, a suspension rod having flanges welded thereon, said flanges interconnecting said studs, and electrolysis bath residues on the surface of said unit, said apparatus comprising gripping and positioning means for said at least one anode unit including two arms having clamping jaws engagable with said suspension rod, means pivotally supporting said arms for swinging in a plane, a rotary milling cutter having an axis of rotation substantially parallel to the axis of said suspension rod, gripping and moving means for said rotary milling cutter comprising at least one pivotal arm located in a plane substantially transverse to the plane of said two pivotal arms, hooding means for collecting and extracting dust, and means for conveying the removed electrolysis bath residues, wherein the position of said cutter with respect to said anode unit is movable enabling said rotary milling cutter to pass successively between the studs and around the studs.

2. An apparatus as claimed in claim 1, wherein the rotary milling cutter means comprises at least one rotary tool which is provided around its periphery with a plurality of teeth made of a hard material resistant to abrasion and impact.

3. An apparatus as claimed in claim 2, wherein the teeth are removable and replaceable.

4. An apparatus as claimed in claim 2 or 3, wherein the teeth are made of a material selected from carbon steels, alloyed steels, hard refractory materials: carbides, nitrides, carbonitrides, diamonds, either solid or in the form of separate layers.

5. An apparatus as claimed in claim 1, wherein the milling cutter means comprises at least one rotary cutter which passes successively through the space between the studs and around the studs.

6. An apparatus as claimed in claim 1, wherein the milling cutter means comprises a plurality of cutters which pass simultaneously through the space between the studs and around the studs.

* * * * *